United States Patent [19]

Yeager

[11] Patent Number: 4,927,397

[45] Date of Patent: May 22, 1990

[54] RAFT INFLATION VALVE

[76] Inventor: Gregory H. Yeager, 309 Jackson, Denver, Colo. 80206

[21] Appl. No.: 314,823

[22] Filed: Feb. 23, 1989

[51] Int. Cl.[5] ..... B63B 35/58

[52] U.S. Cl. ..... 441/41; 137/234; 251/75

[58] Field of Search ..... 114/345; 441/40, 41, 441/90–92, 99; 137/234, 233; 251/303, 339

[56] References Cited

U.S. PATENT DOCUMENTS 1,408,959 3/1922 Royer ..... 137/234

4,478,587 10/1984 Mackal ..... 441/41

4,579,141 4/1986 Arff ..... 441/41

*Primary Examiner*—Joseph F. Peters, Jr.

*Assistant Examiner*—Jesús D. Sotelo

*Attorney, Agent, or Firm*—William P. O'Meara

[57] ABSTRACT

A raft inflation valve assembly comprising a tubular valve body having an air passageway therethrough and a plunger member adapted for selectively preventing or enabling air flow through the valve body. The plunger member is received in the valve body and has a relatively centered, upwardly positioned closed operating state and a relatively skewed, downwardly positioned open operating state.

6 Claims, 1 Drawing Sheet

RAFT INFLATION VALVE

BACKGROUND OF THE INVENTION

The present invention relates generally to inflation valves and, more specifically, to an inflation valve for a river raft.

Inflatable rafts have long been used as lifeboats and as military landing craft, etc. In recent years, inflatable rafts have become increasingly popular for recreational uses such as white-water river rafting.

One advantage that inflatable rafts have over other comparable flotation devices is their capability of being deflated and stored in a relatively compact space when not in use on the water. This capability is enhanced through the use of inflation valves of the type which enable relatively quick inflation and deflation of a associated raft bladder.

One conventional raft valve known in the art as a "military valve" comprises a cylindrical valve body having a threaded interior bore which receives an inner tubular member having matching exterior threads. The inner tubular member comprises a centrally positioned mounting bracket which supports a disk member thereon. An upper end portion of the tubular member comprises radially projecting posts which enable the tubular member to be hand-threaded into and out of the bore in the cylindrical valve body. The tubular member may be threadingly displaced between an open position, wherein the disk member is spaced from the lower portion of the body member, and a closed position, wherein the disk member is placed in sealed relationship with the lower portion of the body member. A problem with this type of valve is that if the valve is screwed too tightly in either the open or the closed position, it may be difficult to unscrew without the use of tools. On the other hand, if this type of valve is not closed tightly enough, it may allow air to leak causing deflation of the raft.

Another type of raft inflation valve is disclosed in Mackal U.S. Pat. No. 4,478,587, issued Oct. 23, 1984, which is hereby specifically incorporated by reference for all that it discloses. This type valve comprises an axially deflectable plunger which may be placed in an open position through hand-depression and rotation of the plunger within a valve body. One problem with a valve such as described in U.S. Pat. No. 4,478,587 is that the valve body and plunger configuration are relatively complex and thus relatively expensive to manufacture.

A need exists for a raft inflation valve which may be easily and rapidly placed in an open or sealed position, but which is relatively simple in construction, relatively inexpensive to produce, and extremely rugged and reliable in operation.

SUMMARY OF THE INVENTION

The invention may comprise a raft inflation valve including: (a) a tubular body member adapted to be mounted in fixed relationship with a raft bladder and having a central bore defined by an interior surface having an upper opening exterior of said raft bladder and a lower opening interior of said raft bladder; said tubular body member comprising a first annular lip surface defining a portion of said central bore and a second annular lip surface defining a portion of said central bore; (b) a plunger member for coacting with said valve body for alternately placing said valve assembly in an open state and a closed state; said plunger member being received in said tubular body member bore and having a shaft portion having a first end which is adapted to engage said first lip portion for maintaining said valve assembly in said open state and having a base portion which is adapted to engage said second lip portion for placing said valve assembly in said closed state; and (c) biasing means for biasing said plunger means upwardly within said valve body bore.

The invention may also comprise a raft inflation valve assembly comprising: (a) a tubular valve body means for providing an air passageway therethrough; and (b) plunger means for selectively preventing or enabling air flow through said valve body means received in said valve body means and having a relatively centered, upwardly positioned closed operating state and having a relatively skewed, downwardly positioned open operating state.

BRIEF DESCRIPTION OF THE DRAWING

An illustrative and presently preferred embodiment of the invention is shown in the accompanying drawings in which.

DETAILED DESCRIPTION OF THE INVENTION

Figure 1:
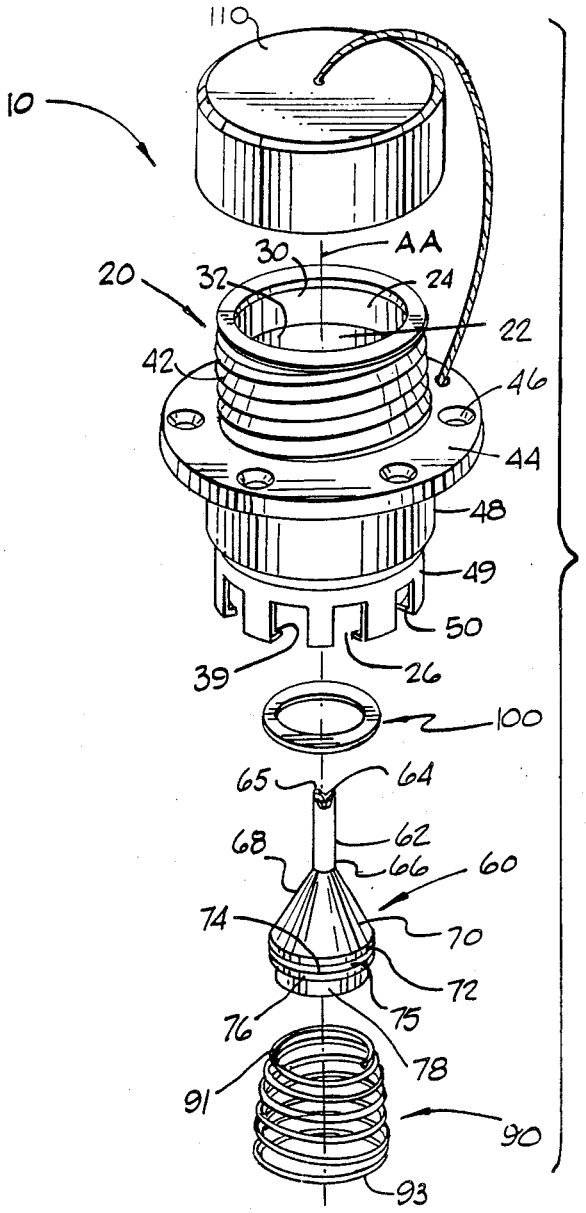
FIG. 1 is an exploded perspective view of a raft inflation valve.

FIG. 1 is an exploded perspective view of a valve assembly 10.

Figure 2:
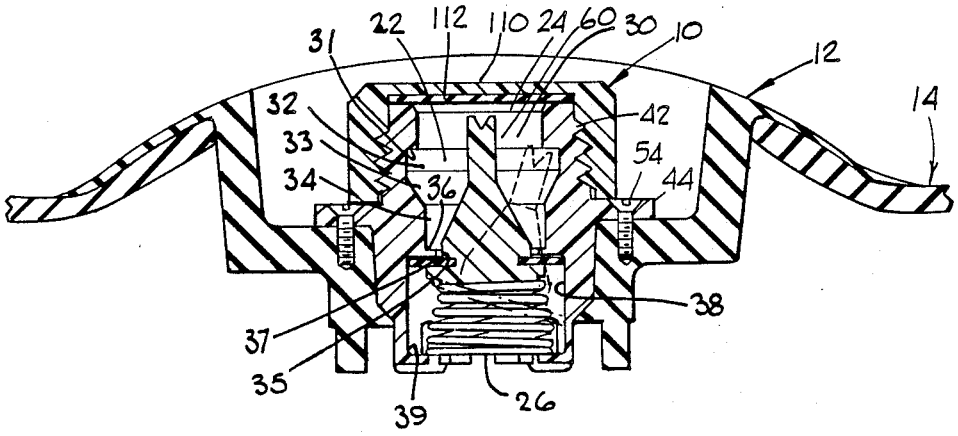
FIG. 2 is a cross-sectional elevation view of the valve of FIG. 1 installed in a raft bladder.

FIG. 2 is a cross-sectional view of valve assembly 10 installed in a conventional mounting boot 12 which is, in turn, installed in a conventional raft bladder 14. The valve assembly 10 comprises a valve body 20 having a central longitudinal axis AA and having an axially extending bore 22 with a central bore axis extending coaxially of axis AA. The bore has a first end opening 24 positioned exteriorly of the raft bladder 14 and a second end opening 26 positioned interiorly of the raft bladder. Bore 22 may be defined, in part, by a first annular sidewall portion 30 having a cylindrical shape, and a second annular sidewall portion 32 having a cylindrical shape and having a larger, e.g. 10% larger, diameter than portion 30. The first annular sidewall portions 30, 32 are connected by a generally radially extending upper lip portion 31. The bore is further defined by a third downwardly and inwardly tapering annular sidewall portion 33. A fourth generally cylindrical annular sidewall portion 34 is connected to the third annular sidewall portion 33. The bore is further defined by a fifth generally cylindrical annular sidewall portion 35 which terminates at a generally radially extending intermediate lip surface 36 and lower lip surface 37. Surface 37 is connected to a sixth generally cylindrical annular sidewall portion 38. Annular sidewall 38 terminates at a bottom lip surface 39.

The valve body may comprise an upper exterior threaded portion 42, an intermediate radially extending flange portion 44 having a plurality of axially extending screw holes 46 therein, and first and second generally cylindrical lower body portions 48, 49 which are adapted to conform with the interior configuration of an associated mounting boot 12. Portion 49 may have a plurality of openings 50 extending radially therethrough which facilitates insertion of a biasing spring 90 described below.

The valve body 20 is adapted to be secured to an associated mounting boot 12 as by screws 54 received through screw holes 46 therein and corresponding screw holes provided in the mounting boot 12.

The valve assembly comprises a plunger member 60 having a plunger shaft portion 64 terminating in a first end 62 which may have a plurality of peripheral prongs 65 formed therein. The plunger shaft has a second end 66 attached to a plunger base portion 68. The plunger base portion may comprise a generally upwardly and inwardly tapering annular surface 70, a generally axially extending cylindrical surface 72, and a generally radially extending surface 74 which is adapted to urged against valve body radially extending lip surface 37 to prevent discharge of air through the valve assembly. The base portion further comprises a cylindrical surface 76, and a recessed cylindrical surface 78 which is adapted to receive an upper portion 91 of a biasing spring 90 thereon.

The biasing spring 90 may be a conventional coil spring having a truncated cone shape. The biasing spring 90 has an upper portion adapted to receive plunger portion 78 therein and a lower portion 93 which is adapted to be engaged by valve bottom lip 39.

A gasket ring 100 may be mounted on the plunger member surface portion 74 to facilitate sealing engagement between the plunger member and the valve body lip surface 37. A gasket receiving recess 75 may be provided on the plunger assembly to facilitate mounting of the gasket ring 100.

A conventional threaded cap 110 having an upper gasket 112 may be provided which is threadingly engageable with the valve body upper threaded portion 42.

The biasing spring 90 has a sufficient axial length such that the plunger member 60 is normally positioned as illustrated in solid lines in FIG. 2 in engaged, sealing relationship with the valve body 20.

The first end 64 of the plunger member shaft may be axially downwardly deflected and radially outwardly deflected as through finger pressure so as to position the shaft end 64 beneath valve body upper lip portion 31. The first end 64 abuttingly engages the lip portion 31 after release of finger pressure, causing the plunger base portion 68 to remain in relatively opened relationship with respect to the valve body, as illustrated in phantom in FIG. 2.

In order to again place the valve in a sealed operating state, it is necessary to again exert downward finger pressure on the plunger shaft first end 64 and to move it towards a radially centered position. Thereafter, release of finger pressure enables the biasing spring to urge the plunger member into the sealed relationship with the valve body illustrated in solid lines in FIG. 2.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A raft inflation valve assembly comprising:

(a) a tubular body member adapted to be mounted in fixed relationship with a raft bladder and having a central bore defined by an interior surface having an upper opening exterior of said raft bladder and a lower opening interior of said raft bladder; said tubular body member comprising a first annular lip surface defining a portion of said central bore and a second annular lip surface defining a portion of said central bore;

(b) a plunger member for coacting with said valve body member, for alternately placing said inflation valve assembly in an open state and a closed state; said plunger member being received in said tubular body member bore and having a shaft portion having a first end which is adapted to engage said first lip portion for maintaining said inflation valve assembly in said open state and having a base portion which is adapted to engage said second lip portion for placing said inflation valve assembly in said closed state; and (c) biasing means for biasing said plunger member upwardly within said valve body bore.

2. The invention of claim 1 wherein said plunger member comprises gasket means thereon for sealingly engaging said second lip portion of said valve body member.

3. The invention of claim 1 wherein said biasing means comprises a coil spring.

4. The invention of claim 3 wherein said coil spring is disposed between the lower end of said plunger member and said lower opening of said valve body bore.

5. The invention of claim 1 wherein said valve body member comprises an upper exterior threaded portion and further comprising a threaded cap screwingly, sealingly engageable with said upper threaded end portion of said valve body member.

6. A raft inflation valve assembly comprising:

(a) a tubular valve body means for providing an air passageway therethrough; and (b) plunger means for selectively preventing or enabling air flow through said valve body means received in said valve body means and having a relatively centered, upwardly positioned closed operating state and having a relatively skewed, downwardly positioned open operating state; wherein said tubular valve body means comprises annular lip means for maintaining said plunger means in said open operating state.

* * * * *